US009829262B1

(12) United States Patent
Suttie et al.

(10) Patent No.: US 9,829,262 B1
(45) Date of Patent: Nov. 28, 2017

(54) OFFSET FIREARM SELECTOR SWITCH

(71) Applicant: Vista Outdoor Operations LLC, Clearfield, UT (US)

(72) Inventors: David W. Suttie, Galesville, WI (US); Christopher D. Laack, Kansas City, MO (US)

(73) Assignee: Vista Outdoor Operations LLC, Farmington, UT (US)

( * ) Notice: Subject to any disclaimer, the term of this patent is extended or adjusted under 35 U.S.C. 154(b) by 0 days.

(21) Appl. No.: 15/144,562

(22) Filed: May 2, 2016

Related U.S. Application Data

(63) Continuation of application No. 14/211,980, filed on Mar. 14, 2014, now abandoned.

(60) Provisional application No. 61/794,135, filed on Mar. 15, 2013.

(51) Int. Cl.
*F41A 17/46* (2006.01)
*F41A 17/20* (2006.01)
*F41A 17/80* (2006.01)

(52) U.S. Cl.
CPC ..... *F41A 17/20* (2013.01); *F41A 17/46* (2013.01); *F41A 17/80* (2013.01)

(58) Field of Classification Search
CPC ..... F41A 17/00; F41A 17/46; F41A 17/56; F41A 17/74
USPC ..... 89/132, 142, 148, 27.12; 42/70.01–70.11
See application file for complete search history.

(56) References Cited

U.S. PATENT DOCUMENTS

| | | | | | |
|---|---|---|---|---|---|
| 3,159,080 | A * | 12/1964 | Freed | F41A 17/74 | 42/7 |
| 4,463,654 | A * | 8/1984 | Barnes | F41A 19/09 | 42/74 |
| 5,212,327 | A * | 5/1993 | Schuemann | F41A 35/06 | 42/70.01 |
| 7,421,937 | B1 * | 9/2008 | Gangl | F41A 17/46 | 42/69.03 |
| 8,276,502 | B1 * | 10/2012 | Wright | F41A 17/46 | 42/70.01 |
| 2007/0180984 | A1 * | 8/2007 | Huther | F41A 17/74 | 89/148 |

(Continued)

OTHER PUBLICATIONS

"DPMS LR-08D AR-15 Oversized Selector Switch." Buzzillions.com. N.p., n.d. Web. Jun. 12, 2015. <http://www.buzzillions.eom/reviews/dpms-lr-08d-ar-15-oversized-selector-switch-reviews#readReviews>.*

(Continued)

*Primary Examiner* — Jonathan C Weber
(74) *Attorney, Agent, or Firm* — Christensen, Fonder, Dardi & Herbert PLLC

(57) ABSTRACT

A safety assembly for a rifle having a pistol grip extending from a receiver, the receiver having an operative safety shaft rotatable between a safety position and a fire position, the shaft positioned above and rearwardly of the trigger, and above and forward of the pistol grip. The shaft rotatable 90 degrees between a safe position and a fire position, a thumb engagement handle having an angled gripping portion angled from the shaft downwardly and rearwardly for the fire position and rearwardly and upwardly in the safe position, whereby the positioning allows that when the firearm is operated and the user grips the pistol grip, the user does not need to release and/or rotate the pistol grip to switch between fire and safe positions of the safety shaft with the thumb of the gripping hand.

10 Claims, 12 Drawing Sheets

(56) References Cited

U.S. PATENT DOCUMENTS

| | | | | |
|---|---|---|---|---|
| 2008/0302235 | A1* | 12/2008 | Lauck | F41A 17/46<br>89/132 |
| 2012/0023801 | A1* | 2/2012 | Rozum | F41A 17/00<br>42/70.08 |
| 2012/0174451 | A1* | 7/2012 | Overstreet | F41A 35/06<br>42/16 |
| 2012/0325044 | A1* | 12/2012 | Brown | F41A 19/33<br>74/548 |
| 2013/0111796 | A1* | 5/2013 | Dionne | F41A 17/00<br>42/70.11 |

OTHER PUBLICATIONS

"2013 SHOT Show: One Hour Special Edition—The 2013 SHOT Show." Shooting USA.com. Web. Dec. 22, 2015. <http://www.shootingusa.com/TV_SCHEDULE/SHOW_32-03/show_32-03.html>.*

* cited by examiner

PRIOR ART

OFFSET FIREARM SELECTOR SWITCH

CROSS-REFERENCE TO RELATED APPLICATIONS

The presented application is a continuation of U.S. patent application Ser. No. 14/211,980, filed Mar. 14, 2014, which claims the benefit of U.S. Provisional Patent Application No. 61/794,135, filed on Mar. 15, 2013, both of which are hereby incorporated by reference herein in their entireties.

FIELD OF THE INVENTION

The present invention is generally directed to a rifle with a safety selector assembly for controlling the engagement of the firearm safety and/or the firing mode of the firearm. Specifically, the present invention is directed to a safety selector with an exterior thumb lever that rotates an internal shaft 90° clockwise and counterclockwise to engage and disengage the firearm safety in certain common rifle configurations.

BACKGROUND OF THE INVENTION

Modern firearms typically include a mechanical safety that can be engaged to prevent the discharge of the firearm by preventing the trigger from being depressed and/or the firing pin from being released. The safety mechanism often comprises a lever, button or toggle switch on the exterior of the firearm that can be moved by the user with their fingers to engage or disengage the safety mechanism. The safety switch is typically positioned proximate to the user's trigger hand such that the user can disengage the safety and pull the trigger with the same hand while still supporting the firearm.

As depicted in FIGS. 1A-4, the positioning of the safety switch is often such that the user must shift the grip of their trigger hand to provide sufficient leverage to actuate the safety switch from the fire position to the safe position. FIG. 3 illustrates from above the right hand gripping the pistol grip in a firing position. FIG. 4 illustrates the right hand rotated clockwise so that the thumb, specifically the thumb knuckle, can engage the front side of the safety switch lever and pull it backward and upward to the safe position. The safety switch requires a relatively substantial force to bias the switch and typically requires that the switch be rotated at least 90 degrees to avoid accidental disengagement of the safety mechanism requiring the user to significantly readjust their grip to provide sufficient force to the selector switch as depicted in FIGS. 3-4. This arrangement provides additional safety by physically separating the trigger mechanism from the safety mechanism requiring at least two distinct and separate motions to disengage the safety and fire the firearm. Moreover, the user typically is required to reposition their grip from the firing position to a secondary position to apply sufficient force to the safety switch. An inherent drawback of this arrangement is that the readjustment of the user's hand slows the user's operation of the firearm and can impact the accuracy of the firearm.

With rifles, a user typically grips the firearm with one hand proximate to the trigger and supports the barrel with their other hand. Adjusting the grip of either hand will change the orientation of the firearm requiring the firearm to be re-aimed at the target. With the trigger hand, the user must also return their trigger finger to the proper position in addition to re-aiming the firearm to accurately use the firearm. If the trigger finger is not properly positioned, the resulting trigger pull may affect the accuracy of the firearm even if the firearm is properly re-aimed. Accordingly, the required adjustment of the user's trigger hand to operate the safety mechanism also requires that the user re-aim the firearm and reposition their trigger hand in the proper firing position.

Conventional rules of safe firearm operation typically require that the safety mechanism remain engaged until immediately before the firearm is fired. In certain combat, policing or home defense situations, the user may be required to train the firearm on the target with the safety engaged to avoid accidental discharge unless the situation changes to require use of the firearm. And in many cases the safety should be reengaged while the firearm is trained on a target. The repositioning of user's trigger hand to disengage the safety before returning the trigger hand to the proper position and re-aim the firearm can substantially slow the user's operation of the firearm and often require reacquisition of the target. It would be highly advantageous to be able to disengage and engage the safety without having to readjust the gripping of the firearm and without having to re-aim the firearm. As these situations are often highly dangerous, any delay introduced by the repositioning of the user's trigger hand and re-aiming or reacquiring a target can present a substantial risk to the user.

In particular, with the AR-10 and AR-15 style of firearms, the safety is operated by a linear thumb lever that is positioned above and generally rearward of the grip of the firearm and can be rotated with the thumb of the user's trigger hand to engage or disengage the safety mechanism as depicted in Prior Art FIGS. 1A to 4. The thumb lever comprises a circular flat plate, the circular flat plate having an exposed planar surface, parallel to the side wall surface of the lower receiver of the firearm. The circular plate being coaxial with an operative safety shaft connected thereto and extending into the lower receiver and trigger mechanism, the operative shaft normal to the side wall surface. A linear arm extends from the circular shaft along the side wall surface of the lower receiver of the firearm. The linear arm perpendicular to the operative shaft extending into the lower receiver. The linear arm unitary with the circular plate and being slightly spaced from the side wall surface of the lower receiver. The linear arm having a primary longitudinal arm axis and a height of about 0.240 to 0.270 inches measured in a direction perpendicular to the side wall surface of the lower receiver and a length of 0.600 to 0.750 inches in a direction perpendicular to the axis of the operative shaft and parallel to the side wall surface of the lower receiver, and a thickness measured perpendicular to the length and in a direction parallel to the side wall surface of the lower receiver of 0.200 to 0.250 inches. The linear arm is generally rounded about an axis extending in the direction of the length of the arm and on the ends of the arm. The surface of the arm confronting the side wall surface being flat and parallel to the side wall surface. Ridges may extend lengthwise along the arm providing a gripping surface. The arm rotates the operative shaft clockwise and counterclockwise along a 90° arc to operate the safety mechanism. Typically, the lever is oriented such that the arm is horizontal and pointed toward the rear of the firearm when the safety mechanism is engaged and downward and vertical with the safety is off and the firearm ready to fire. The circular plate may have arrow structure or indicia pointing in a direction opposite the direction in which the arm is extending from the circular plate. The entire exposed length of a conventional AR safety, including the circular plate and arm may be about 1.00 to 1.20 inches. The circular plate may have a diameter of about 0.40 to 0.51 inches and a thickness of about 0.050 to 0.065 inches. The thumb lever is positioned such that the user can easily pivot or rotate their thumb upwards and rearward to engage the arm with the inside of the thumb anywhere between the first and second knuckles without altering the grip of the three lower fingers and the heel of the trigger hand. The downward rotation of the thumb effectively returns the user's hand to the original firing position. The heel of the thumb may slightly separate from the back of the grip. In that the grip is primarily secured in the hand by the three lower fingers wrapped there around, the security of the grip is maintained and the firearm need not be re-aimed or the target reacquired.

In contrast, rotating the switch back to the safe position can be far more problematic. Typically, the vertical orientation of the lever arm makes the lever arm difficult to engage with the thumbnail side or upper side of the knuckle without requiring the user to substantially readjust their grip. Moreover, the substantial force required to rotate safety mechanism can result in only partial rotation of the safety mechanism if the user does not properly grip the arm leaving the user believing that the firearm is safe when in fact the safety mechanism has not been engaged. Similarly, depending on the size of the user's hand, the must often reach forward with their thumb to engage the arm against the tip or enough of the front side of the arm to apply sufficient force to rotate the arm. The substantial readjustment of the user's grip can force the user to release or readjust their grip to safely engage the safety mechanism. A similar consideration is that certain users are unable to extend their trigger finger to take the trigger finger off the trigger The linear lever arm of the AR family of firearms typically requires that the user change their grip to operate the safety of the firearm, pulling the sight away from the line of sight of the user and causing loss of target acquisition, thus requiring re-aiming for further shooting and slowing the operation of the firearm. As AR-type rifles are commonly used in military and policing applications, improved functionality of the firearm safety mechanism could enhance safety and efficiency.

As such, there is a need for a means of permitting effective operation of a safety on AR style firearms without requiring the user to readjust the grip of their trigger hand.

SUMMARY OF THE INVENTION

The present invention is directed to an AR style firearm having a safety assembly that can be operated to engage or disengage the safety with minimal or no readjustment of the user's grip and with sufficient commonality to a conventional AR style firearm such that no retraining is necessary. Specifically, the safety assembly may comprise a safety mechanism having an operative shaft extending into the lower receiver and exposed on the side wall surface positioned conventionally rearwardly and above the trigger. The shaft having a manual thumb engagement handle. The manual thumb engagement handle, in an embodiment, having a circular plate concentric with the operative shaft, a lever arm extending radially outward therefrom, the lever arm having an proximal (to the shaft) or upper arm portion that extends downward in the conventional direction in the safety off (fire) position and horizontally and rearwardly in the safety on (can't fire) position. The lever arm further having a distal or lower arm portion that extends at a rearward angle from a vertical line, when the upper arm portion is vertical, extending downwardly from the operative shaft, at an angle from vertical of 25 degrees to 50 degrees, such that the angle between the upper arm portion and lower arm portion, going in a clockwise direction, is between 130 degrees and 155 degrees. The entire exposed length of the thumb handle may be about 1.00 to 1.40 inches. The upper arm and lower arm having a height of about 0.24 to 0.28 measured in a direction perpendicular to the side wall surface of the lower receiver and a thickness measured perpendicular to the length and in a direction parallel to the side wall surface of the lower receiver of 0.200 to 0.250 inches. The length of the upper or distal arm may be about 0.25 to 0.35 inches, the length of the lower arm may be about 0.60 to 0.90 inches The angle facing rearwardly when the safety is in the off (fire) position and upwardly when the safety is on (can't fire) position. The manual thumb engagement handle rotatable 90 degrees between the horizontal position and the vertical position to rotate an internal shaft between the safe position in which the internal shaft engages the trigger to prevent the trigger from being depressed and a fire position in which the internal shaft is disengaged or spaced from the trigger mechanism allowing the trigger to be depressed. The thumb handle further has a thumb pad or plate extending along the side wall surface with an outwardly facing surface, parallel to the side wall surface, the plate having a forward peripheral edge aligned with a forward margin of the upper arm portion when the manual thumb engagement handle is downward in the fire position and a lower peripheral edge aligned with the distal end of the lower arm portion. The pad positioned forwardly of the lower arm portion. The plate and lower arm portion providing a recess region for readily receiving the thumb knuckle of the user's thumb.

The offset of the angled gripping portion allows the user to more efficiently rotate the lever without sacrificing safety provided by a full 90° degree rotation of the drive shaft required to disengage the safety mechanism.

When the lever is positioned in the safe position, the front of the user's thumb can be used to apply a downward pull force to the angled gripping portion to rotate the shaft to disengage the trigger mechanism and allow the trigger to be depressed. The offset moves the distal end of the lever arm horizontally forward and upward relative to the user's trigger hand as compared to traditional linear lever switches allowing the user to more easily engage the end of the arm to apply the maximum leverage to rotate the thumb engagement handle without having to reach their thumb as far back horizontally. Once the shaft is rotated into the second position, the back of the user's thumb can be used to apply a pushing force to the angled gripping portion generally perpendicular to the secondary axis to rotate the shaft in the opposite direction back to the starting orientation. The offset of the angled gripping portion corresponds to the angle of the user's thumb as the thumb is rotated to engage the lever arm and apply the push force to the angle portion such that angle portion provides a large surface against which the push force can be applied. This arrangement allows for the user to rotate the shaft without having to adjust their grip to properly orient their thumb or apply more leverage to rotate a linear shaft. As a result, users can maintain the orientation of the firearm trained on the target through the activation or deactivation of the firearm without shifting their grip or re-aiming the firearm. Moreover, as only the thumb of the user's trigger hand needs to be moved to operate the safety assembly, the risk of inadvertent discharge from the trigger being depressed by the user's other fingers is minimized.

A firearm, according to an embodiment of the present invention, can comprise an action assembly, a trigger assembly and a safety assembly. The trigger can further comprise a connector operably linked to the sear, wherein the depressing the trigger rotates sear. The selector further comprises a shaft rotatable by a thumb engagement handle having an angled gripping portion, wherein the lever arm has a primary axis and the angled gripping portion has a secondary axis transverse to the primary axis. The shaft further comprises cut out portion defining a planar surface engagable to the trigger to restrict the movement of the trigger.

In operation, the shaft is rotatable between a first position in which the planar surface is transverse to the travel axis of the trigger preventing the trigger from being pulled and a second position in which the planar surface is parallel to the travel axis allowing the trigger to be pulled. In the first position, the primary axis is generally parallel to the travel axis of the trigger while the secondary axis is transverse to the travel axis. When in the first position, the user can grip the angled gripping portion to apply a pull force to the thumb engagement handle parallel to the secondary axis rotating the shaft into the second position. In the second position, the primary axis is generally perpendicular to the travel axis of the trigger. When in the second position, the user can apply a force with the back of their thumb to the angled gripping portion to apply a push force transverse to the lever portion to rotate the thumb engagement handle back to the first position.

The above summary of the various representative embodiments of the invention is not intended to describe each illustrated embodiment or every implementation of the invention. Rather, the embodiments are chosen and described so that others skilled in the art can appreciate and understand the principles and practices of the invention. The figures in the detailed description that follow more particularly exemplify these embodiments.

BRIEF DESCRIPTION OF THE DRAWINGS

The invention can be completely understood in consideration of the following detailed description of various embodiments of the invention in connection with the accompanying drawings, in which:

FIG. 2B illustrates the full engaged shooting grip of FIG. 2A has been released in order to engage the selector switch with the inside of the thumb at the knuckle.

Figure 1A:
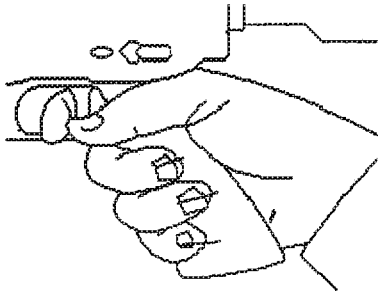
FIG. 1A PRIOR ART
FIGS. 1A-1D are representative figures illustrating the hand movements required to rotate a conventional selector switch from a safe position to a fire position.
Figure 1B:
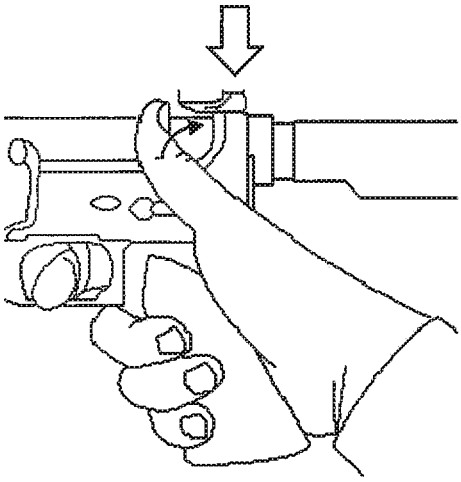
FIG. 1B PRIOR ART
Figure 1C:
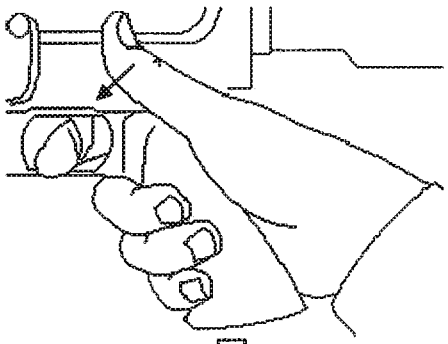
FIG. 1C PRIOR ART
Figure 1D:
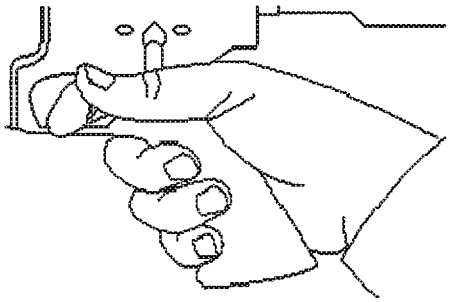
FIG. 1D PRIOR ART
Figures 2A, 2B, 2C, 2D, 2E:
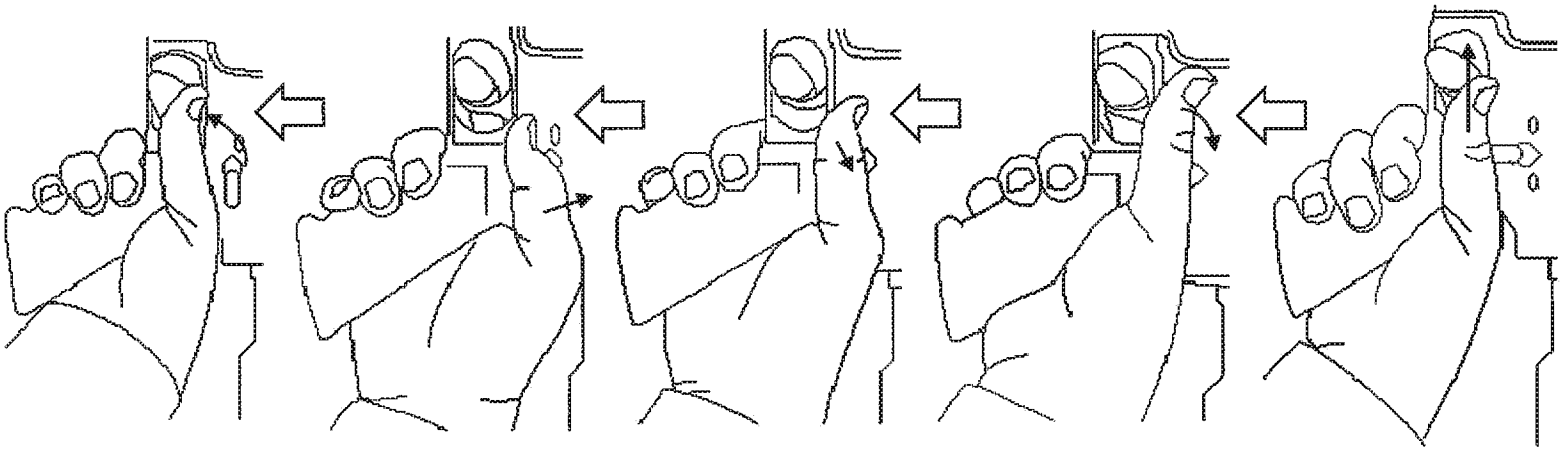
FIG. 2A PRIOR ART
FIG. 2B PRIOR ART
FIG. 2C PRIOR ART
FIG. 2D PRIOR ART
FIG. 2E PRIOR ART
FIGS. 2A-2E are representative figures illustrating the hand movements required to rotate a conventional selector switch from a safe position to a fire position.
Figure 3:
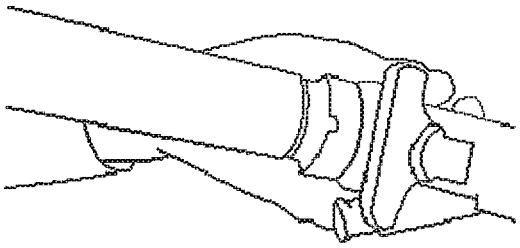
FIG. 3 PRIOR ART
FIG. 3 is a representative top view of a rifle equipped with a conventional selector switch gripped by a hand positioned in a firing position.
Figure 4:
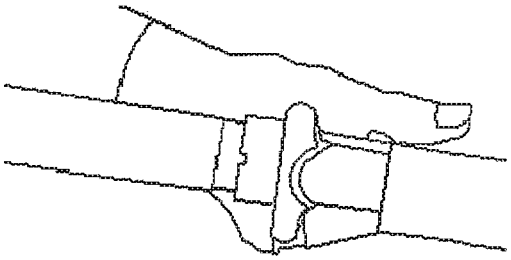
FIG. 4 is a representative top view of a rifle equipped with a conventional selector switch gripped by a hand repositioned to actuate the conventional selector switch.

While the invention is amenable to various modifications and alternative forms, specifics thereof have been depicted by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE DRAWINGS

As depicted in FIGS. 12-17C, a firearm 10, according to an embodiment of the present invention, comprises an action assembly 12, a trigger assembly 14 and a safety assembly 16. The action assembly 12 can further comprise a bolt carrier 18 and a spring loaded hammer 20. In certain embodiments directed to automatic AR-type actions as depicted in FIGS. 12-15, the action assembly 12 can further comprise a sear 22. The bolt carrier 18 can further comprise a tail portion 24 and a bolt 26 that can be struck by the hammer 20 to ignite a cartridge. The sear 22 is rotatable around a central axis and can further comprise a protrusion 28 for engaging and cocking the hammer 20 as the sear 22 is rotated. The sear 22 also further comprises a foot 30 engageable by the tail portion 24 of the bolt carrier 18. The trigger assembly 14 further comprises a trigger 32 extending from a trigger carrier 34 such that pulling the trigger 32 pivots the trigger carrier 34 around an axis. The trigger assembly 14 also comprises a connector 36 having an elongated linkage 38 also rotatable around an axis. The elongated linkage 38 extends between the trigger carrier 34 and the sear 22 such that the rotation of the trigger carrier 34 is translated to the sear 22 to rotate the sear 22 by the linkage 38 rotating around the axis. The trigger assembly 14 further comprises a grip 40 that can be gripped by a user to position the user's trigger hand proximate to the proper position to pull the trigger 32. As depicted, the grip 40 comprises a pistol grip for an AR-type action, but can comprise any conventional grip 40 for a firearm 10 including, but not limited to straight stock grips or integrated stock pistol-style grips.

In certain embodiments directed to semiautomatic only AR-type actions as depicted in FIGS. 16A-17C, the action assembly 12 can alternatively comprise a disconnector 62 that engages hammer 20 to prevent continual firing of the hammer 20. The hammer 20 also further comprises a notch 64 and a hook portion 66. The trigger carrier 34 engages the notch 64 when the hammer 20 is in the cocked position to retain the hammer 20 until the trigger 32 is depressed and pivots the trigger carrier 34 out of engagement with the notch 64 allowing the hammer 20 to rotate. After firing, the disconnector 62 is hooked to engage the hook portion 66 of the hammer 20 as the hammer 20 rotates back into the cocked position to rotate the hammer 20 in the cocked position until the trigger 32 is released allowing the trigger carrier 34 to pivot back into the original position. As the trigger carrier 34 is reengaged to the notch 64, the disconnector 62 is disengaged from the hook portion 66 to free the hammer 20 for firing.

Figure 5A:
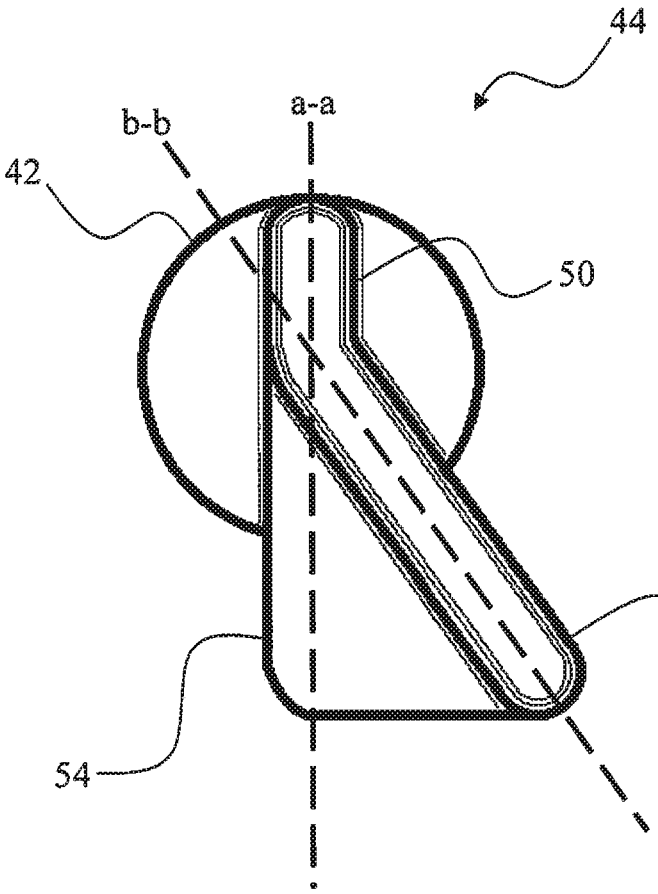
FIGS. 5A and 5B are a side view and a cross-sectional of a selector switch according to an embodiment of the present invention.
Figure 5B:
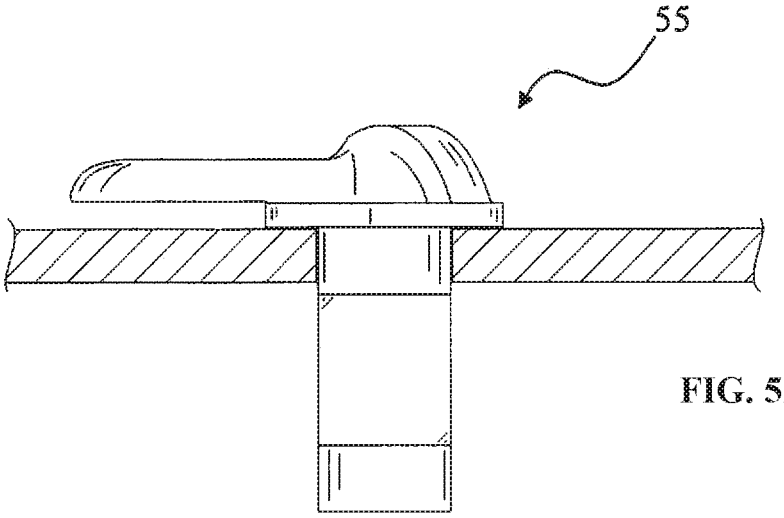
Figure 6:
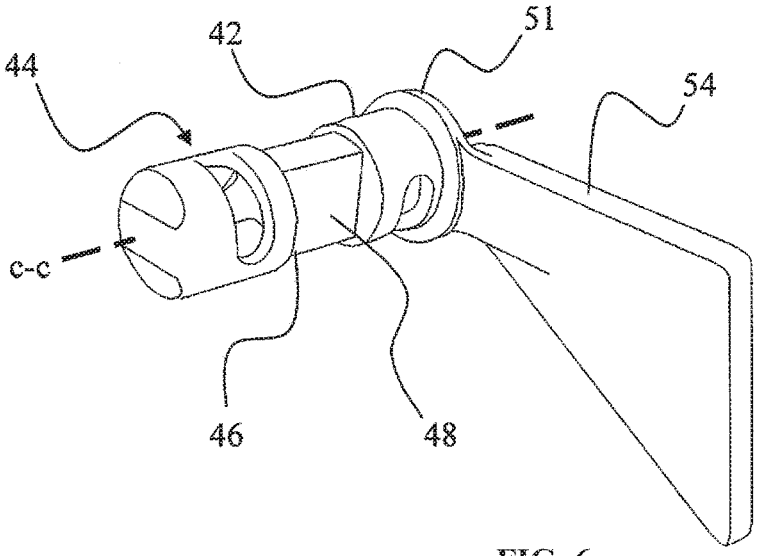
FIG. 6 is a rear perspective view of a selector switch according to an embodiment of the present invention.
Figure 7:
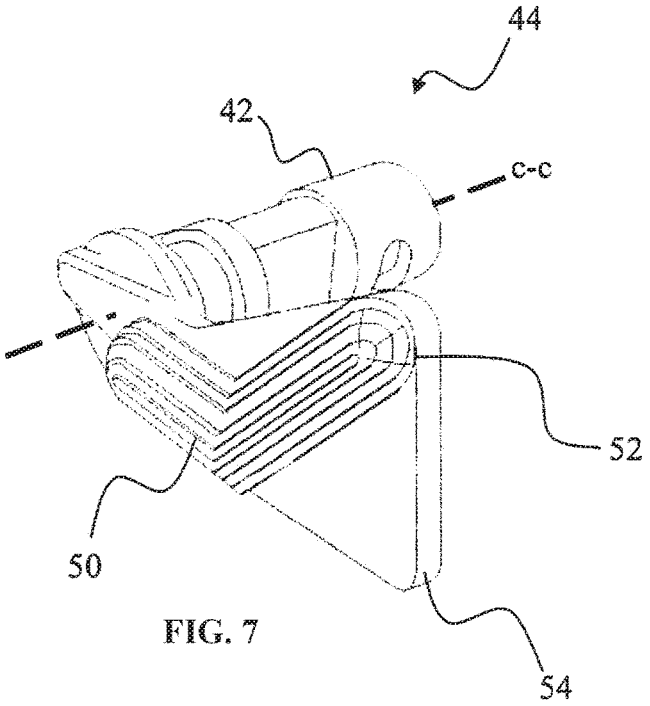
FIG. 7 is a front perspective view of a selector switch according to an embodiment of the present invention.
Figure 8:
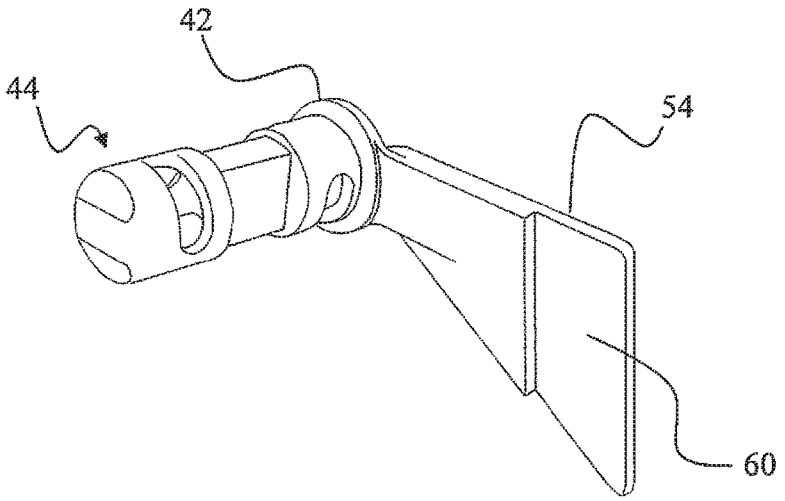
FIG. 8 is rear perspective view of a selector switch having a cut out portion according to an embodiment of the present invention.
Figure 9:
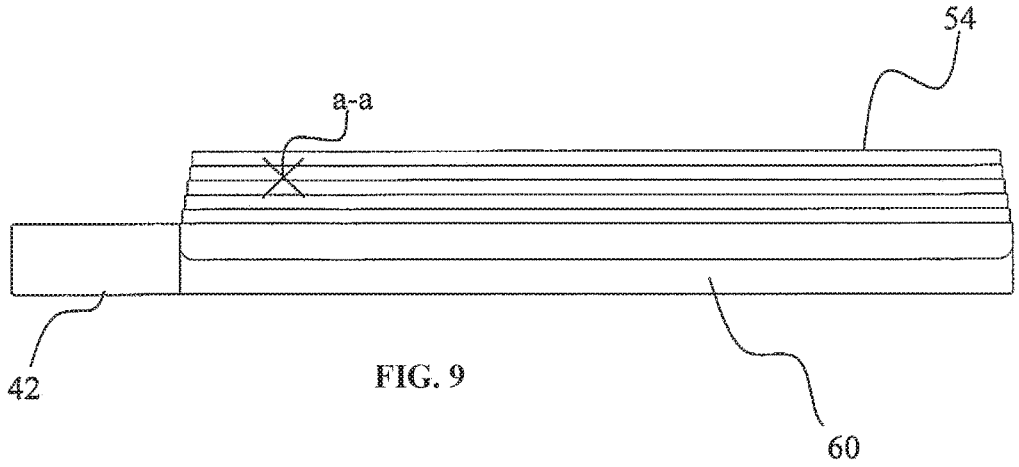
FIG. 9 is a rear view of a selector switch having a cut out portion according to an embodiment of the present invention.
Figure 10A:
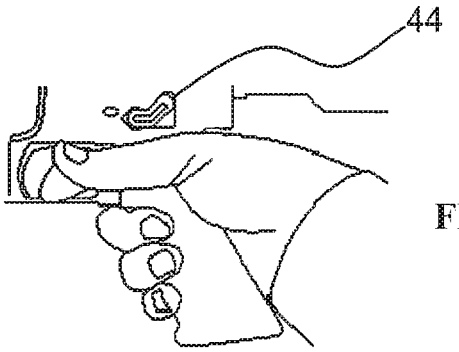
FIG. 10A-10C are representative figures illustrating the hand movements required to rotate a selector switch according to an embodiment of the present invention from a safe position to a fire position.
Figure 10B:
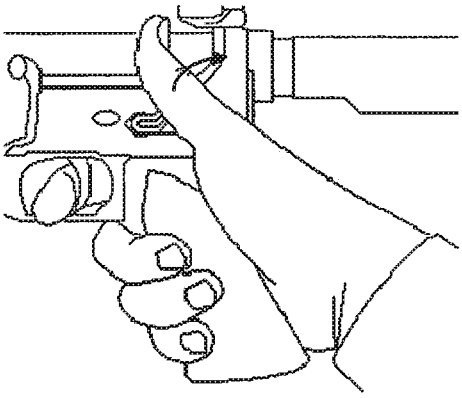
Figure 10C:
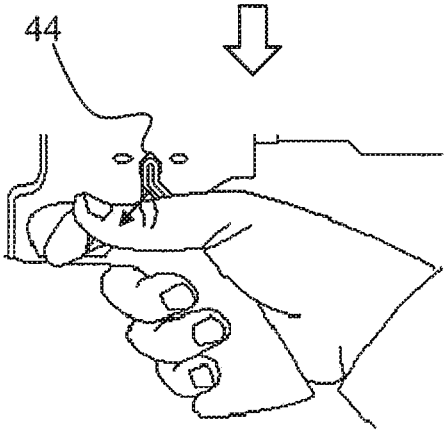
Figure 11A:
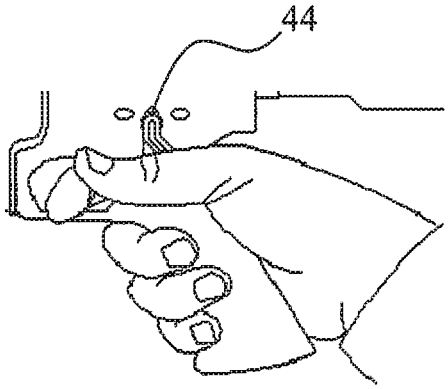
FIG. 11A-11C are a representative figures illustrating the hand movements required to rotate a selector switch according to an embodiment of the present invention from a safe position to a fire position.
Figure 11B:
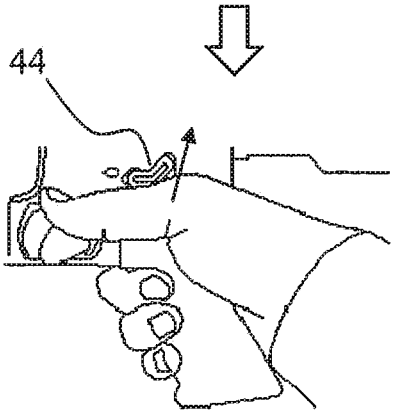
Figure 11C:
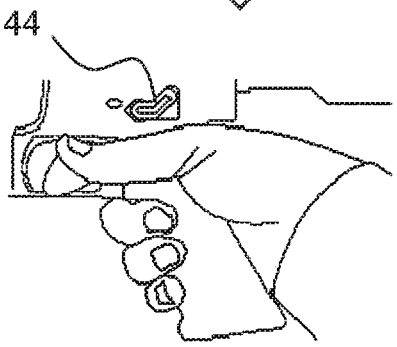
Figure 12:
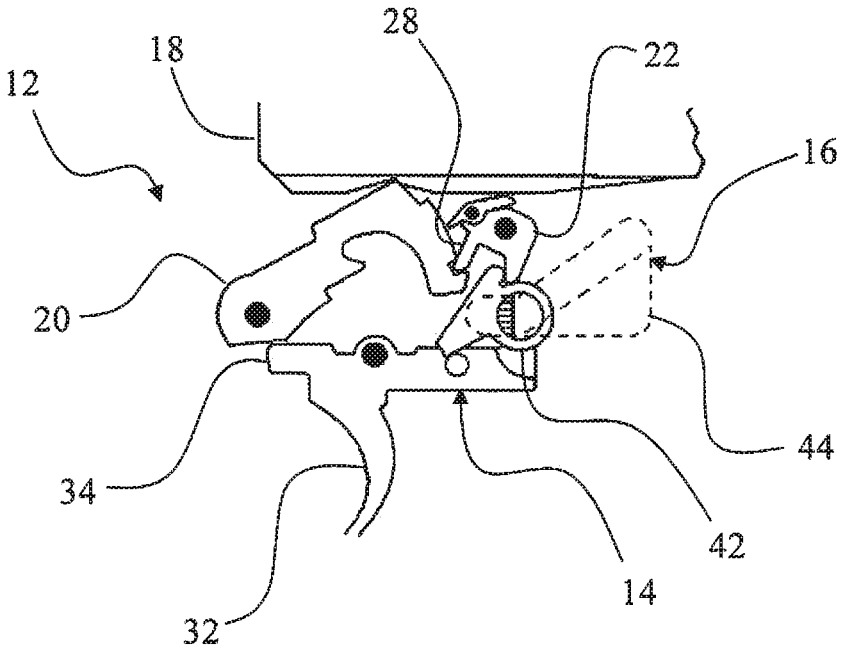
FIG. 12 is a schematic view of a firearm assembly according to an embodiment of the present invention, wherein the firearm is on safe and unable to fire.
Figure 13:
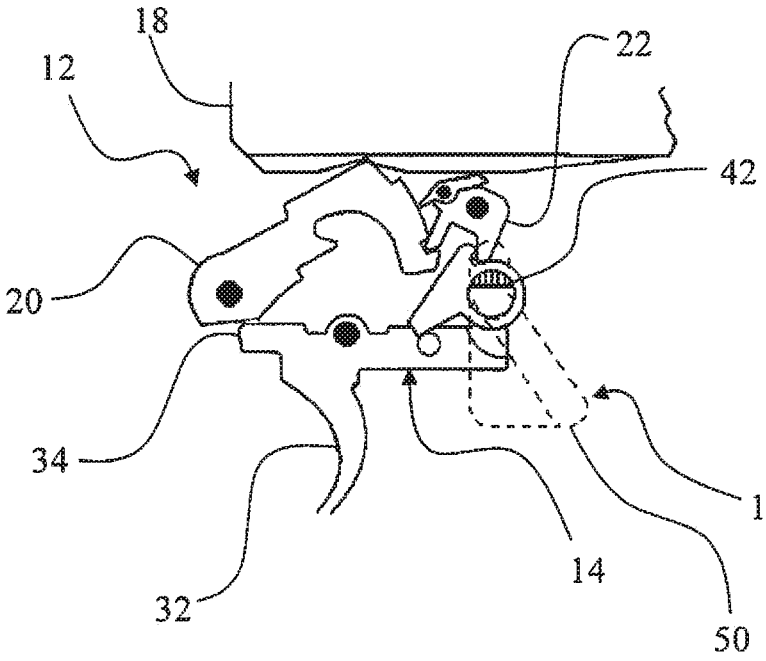
FIG. 13 is a schematic view of the firearm assembly of FIG. 2, wherein the firearm safety has been disabled and the firearm is ready to fire.
Figure 14:
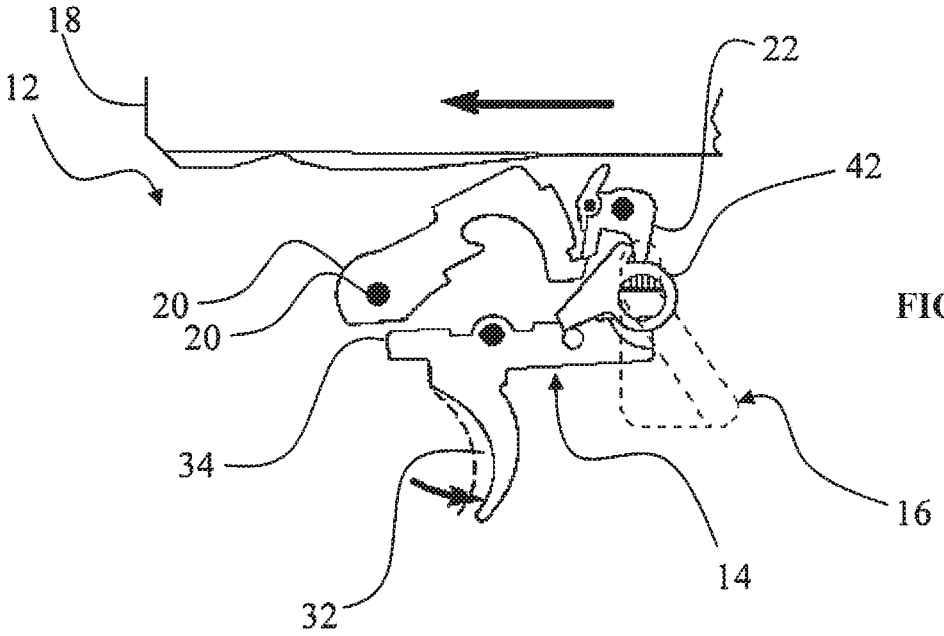
FIG. 14 is a schematic view of the firearm assembly of FIG. 2, wherein the trigger has been pulled to operate the firearm assembly.
Figure 15:
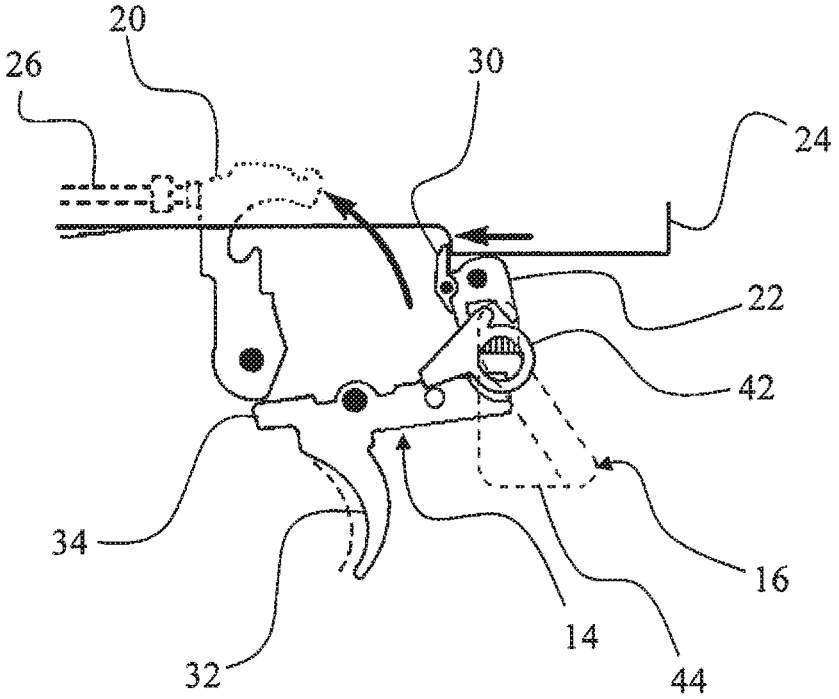
FIG. 15 is a schematic view of the firearm assembly of FIG. 2, wherein the hammer of the firearm assembly has triggered the firing of a cartridge.
Figure 16A:
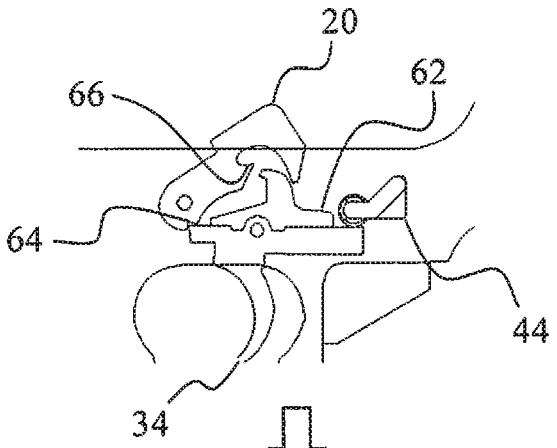
FIGS. 16A-16D are schematic figures illustrating internal operation of a firearm with a firearm safety according to an embodiment of the present invention through a firing sequence.
Figure 16B:
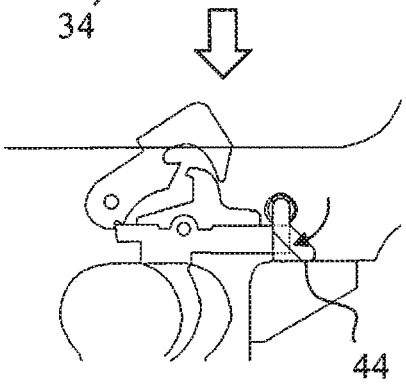
Figure 16C:
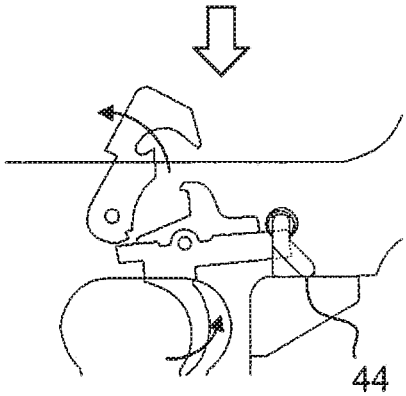
Figure 16D:
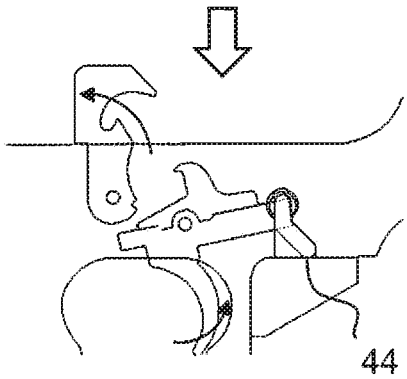
Figure 17A:
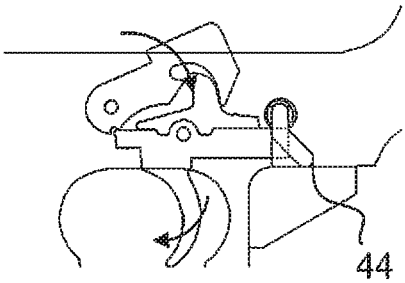
FIGS. 17A-17C are schematic figures illustrating internal operation of a firearm with a firearm safety according to an embodiment of the present invention through a reloading sequence and switching the safety to safe.
Figure 17B:
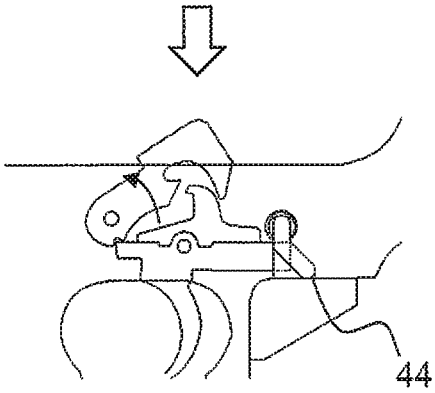
Figure 17C:
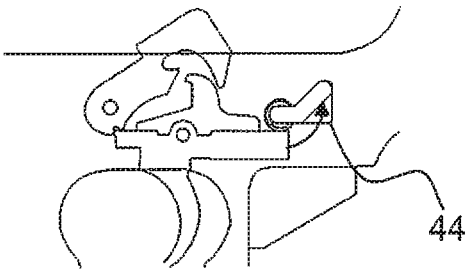

As depicted in FIGS. 5A-7, the safety assembly 16 further comprises an operative safety shaft 42 rotatable by a lever switch or thumb engagement handle 44. The shaft 42 has a notch 46 having a planar surface 48 that is reoriented when the shaft 42 is rotated. The thumb engagement handle 44 can further comprise a lever arm 50 is positioned at the end of the shaft 42, wherein a force can be applied to the lever arm 50 creating a force moment to rotate the shaft 42. In certain embodiments, the lever arm 50 can be comprise as an outwardly protruding rib, a circular flange 51 or a thumb pad 54 configured as a plate. The lever arm 50 has a primary axis a-a that intersects the rotational axis of the shaft 42. When the firearm 10 is held level such that the barrel of the firearm is generally horizontal, the primary axis a-a is horizontal when the safety assembly 16 is engaged to prevent firing of the firearm 10 and vertical when the safety assembly 16 is disengaged to allow firing of the firearm 10. The lever arm 50 further comprises an angled gripping portion 52 defining a secondary axis b-b transverse to the primary axis a-a. In one embodiment, the angled gripping portion 52 or distal arm portion can be offset between 30° and 50° from the primary axis a-a. In yet another embodiment, the angled gripping portion 52 can be offset about 40° from the primary axis a-a. In certain embodiments, the base plate or thumb pad 54 can reinforce the lever arm 50 wherein the lever arm 50 and angled gripping portion 52 protrude from the thumb pad 54. As depicted in FIGS. 6-8, in one embodiment, the lever arm 50 can be offset from the shaft 42 to increase the effective length of the lever arm 50 and ease rotation of the shaft 42 in response to a force applied by a user's finger. In an embodiment the gripping portion is straight from end to end and is in alignment with the central axis of the operative safety shaft. In embodiment one end of the gripping portion is positioned at the rotational axis of the operative safety shaft.

The rotational axis of the operative safety shaft is positioned about 1.2-1.4 inches rearwardly of the central part of the trigger (when viewed from the side) where the trigger exits the receiver and about 0.6 inches above same. The forward edge of the pistol grip aligned, that is vertically aligned, with the rotational axis of the operative safety shaft.

As depicted FIGS. 5A-5B, in an embodiment of the present invention, a lower surface 59 of the thumb pad 54 can be positioned a predetermined distance from the side wall of the firearm 10 or define a cutout portion 60. The spacing or cutout portion 60 allows rotation of the thumb engagement handle 44 without the base portion 54 contacting the indicator nubs that align with the thumb engagement handle 44 when the thumb engagement handle 44 is rotated between the firing position and safe position.

As depicted in FIGS. 12-15, in operation, the bolt carrier 18 is movable between a chambered position in which the bolt carrier 18 engages the chamber of the firearm 10 and an ejector position in which the bolt carrier 18 is moved reward to open the chamber for ejection and/or loading of a cartridge.

When the bolt carrier 18 is positioned in the chambered position with a cartridge chambered within the firearm 10 chamber, the chambered cartridge is fired by pulling the trigger 32 to rotate the trigger carrier 34, which rotates the sear 22 via the elongated linkage 38. In this firing configuration, safety assembly 16 is engaged to prevent firing of the firearm 10 by rotating the shaft 42 such that the planar surface 48 is generally perpendicular to the trigger carrier 34. In this orientation, a portion of the shaft 42 engages the trigger carrier 34 to prevent the trigger carrier 34 from rotating when the trigger 32 is pulled, thereby locking the trigger 32 in place. The safety assembly 16 is disengaged by rotating the shaft 42 such that the planar surface 48 is generally parallel to the trigger carrier 34, which disengages the shaft 42 from the trigger carrier 34 unlocking the trigger 32 and allowing the trigger carrier 34 to rotate when the trigger 32 is pulled. The rotation of the sear 22 engages the protrusion 28 of the sear 22 to the hammer 20 to cock the hammer 20 back and winding the spring of the hammer 20. In one embodiment, the hammer 20 can define a notch 56 engageable by the protrusion 28. Once the sear 22 has a rotated a predetermined distance, which corresponds to fully cocking the hammer 20, the protrusion 28 disengages from the hammer 20 allowing the hammer 20 to swing forward to strike the bolt 26 and fire the cartridge.

When the bolt carrier 18 is positioned in the ejector position, the hammer 20 is un-cocked such that the hammer 20 engages the bolt carrier 18. In one embodiment, the bolt carrier 18 can define a notch 58 engageable by the hammer 20 to prevent the bolt carrier 18 from moving until the trigger 32 is pulled. In this configuration, rotating the shaft 42 such that the planar surface 48 is perpendicular to trigger carrier 34 to prevent rotation of the trigger carrier 34 locks both the trigger 32 and the carrier 18 in place until the operative safety shaft 42 is rotated to disengage trigger carrier 34. Upon pulling the trigger 32, the sear 22 is rotated by the rotating trigger carrier 34 via the linkage 38 of the connector 36. The rotation of the sear 22 cocks the hammer 20 allowing the bolt carrier 18 to move forward toward the chambered position. The sear 22 maintains the hammer 20 in the cocked position until the tail portion 24 of the carrier 18 engages the foot 30 of the sear 22 to disengage the sear 22 from the hammer 20 allowing the hammer 20 to swing forward to strike the bolt 26 and fire the cartridge.

As depicted in FIGS. 8-13, the shaft 42 can be rotated between the safe position restricting the rotation of the trigger carrier 34 and the disengaged allowing rotation of the trigger carrier 34 to permit firing of the firearm 10. The safety shaft 42 can be rotated into the disengaged position from the engaged position by applying a downward force with the front of the user's thumb to the angled gripping portion 52 to rotate the safety shaft 42 to position the planar surface 48 parallel to the trigger carrier 34 and allow firing of the firearm 10. The downward force provided by the front side of the thumb is substantially similar to the force provided to effect the 90° rotation to a conventional single linear lever switch. The offset of the angled gripping portion 52 provides a more natural hand movement to provide the same downward force more efficiently without requiring that the user readjust their grip or aim. The safety shaft 42 can be returned to the engaged position by applying a push force with the back of the user's thumb to the angle portion 52 to rotate the safety shaft 42 such that the planar surface 48 is perpendicular to the trigger carrier 34 and the shaft 42 engages the trigger carrier 34 to prevent firing of the firearm 10. The angled gripping portion 52 provides an efficient surface against with the user can brace their thumb to rotate the lever arm 50 without releasing their grip on the grip 40.

While the invention is amenable to various modifications and alternative forms, specifics thereof have been depicted by way of example in the drawings and described in detail. It is understood, however, that the intention is not to limit the invention to the particular embodiments described. On the contrary, the intention is to cover all modifications, equivalents, and alternatives falling within the spirit and scope of the invention as defined by the appended claims.

The invention claimed is:

1. A rifle firearm, comprising:

a receiver with a pistol grip, a trigger forwardly of the pistol grip, a safety selector switch rearward of and above the trigger, the safety selector switch having a fire position and a safe position, the safety selector switch comprising:

an operative shaft extending through the receiver and rotatable 90 degrees between a safe position and a fire position, a thumb engagement handle fixed to an end of the shaft, the thumb engagement handle extending vertically and downwardly when the safety selector switch is in the fire position and horizontally and rearwardly when the safety selector switch is in the safe position, the thumb engagement handle comprising a thumb pad with an outwardly facing flat pad surface and an inwardly facing surface confronting an exterior receiver side wall surface, the thumb pad configured as a plate and having an outermost periphery with a generally triangular shape with one corner of the triangular shaped plate at the end of the shaft and the sides of the triangular shaped plate adjacent to the one corner of the triangular shape plate diverging away from the one corner, wherein when the safety selector switch is in the fire position a forward peripheral edge of the triangle shaped plate and extends vertically from the end of the shaft downward, a rearward peripheral edge of the triangle shaped plate extends from the shaft downward and rearwardly, and a lower peripheral edge of the triangle shaped plate extends horizontally, the thumb pad further comprising an elongate thumb engagement rib extending outwardly from the triangular shaped plate, wherein when the safety selector switch is in the fire position, the elongate thumb engagement rib having an arm portion that is at the rearward peripheral edge of the triangular shaped plate and that extends the length of the rearward peripheral edge, the arm portion projecting outwardly from the triangular shaped plate, the outwardly facing flat pad surface extending from the arm portion forwardly to the forward peripheral edge of the triangular shaped plate, the thickness of the arm portion projecting from the triangular shaped plate being greater than the thickness of the triangular shaped plate at the outwardly facing flat pad surface, the arm portion being straight and extending downwardly and rearwardly at an angle measured from vertical of between 25 to 50 degrees, whereby when the safety selector switch is in the fire position, the arm portion extends upwardly and rearwardly from the operative shaft.

2. The firearm of claim 1, wherein the arm portion is covered with ribbing, the ribbing extending longitudinally on the arm portion and providing a gripping surface.

3. The firearm of claim 1, wherein the operative shaft has an axis and wherein the arm portion has an axis extending lengthwise with respect to the arm portion and the arm portion axis is in alignment with the axis of the operative shaft.

4. The firearm of claim 1, wherein the selector switch is in the fire position, the generally triangular thumb pad having one side parallel to the primary axis and having one corner of the triangle proximate the end of the shaft, having another corner of the triangle positioned below and distal from the end of the shaft, and having a third corner position rearward of the another corner and rearward and below distal from the one corner.

5. A safety mechanism for a firearm having a spring-loaded hammer and a sear rotatable to lock the hammer in a cocked position and to disengages the hammer to allow the hammer to rotate and strike a firing pin, comprising:

a safety shaft defining an engagement surface, wherein shaft is rotated between an engaged position in which the engagement surface engages the sear to prevent rotation of the sear defining a safe position and a disengaged position in which the engagement surface is positioned to allow the sear to freely rotate defining a fire position; and a thumb engagement handle affixed to the end of the safety shaft for manually rotating the safety shaft between the safe position and fire position, wherein the thumb engagement handle comprises a thumb pad configured as a plate and with the outer periphery of the plate having a right triangular shape defining a right triangularly shaped plate, the thumb engagement portion further having a straight arm portion that follows a side of the triangularly shaped plate opposite a right angle corner of the triangularly shaped plate, the straight arm portion projecting outwardly with respect to a flat outwardly facing surface on the thumb pad.

6. The firearm of claim 5, wherein the lever arm and the triangular shaped plate defining a rearward recess region for readily receiving a knuckle of a user's thumb.

7. A rifle firearm, comprising:

a receiver with a pistol grip;

a safety shaft extending into the receiver and accessible out of the receiver from a side wall surface, the safety shaft having a trigger obstructing position and a trigger release position, a lever switch affixed to an end of the safety shaft for manually rotating the safety shaft between the obstructing position and the trigger release position, wherein the lever switch comprises, as viewed when in the lever switch is in the trigger release position, a thumb pad configured as a plate extending parallel to the side wall surface, the thumb pad having a forward positioned triangular shaped outwardly facing flat surface below the safety shaft, a straight arm portion projecting outwardly with respect to the outwardly facing flat surface and positioned exclusively rearwardly of the outwardly facing flat surface, the arm portion having a thickness greater than the thumb pad at the outwardly facing flat surface arm portion positioned at an angle equating to between 4:00 and 5:30 on a clock face when the safety shaft is in the trigger release position.

8. The firearm of claim 7, wherein the arm portion is angled rearwardly and upwardly when the lever switch is positioned in a horizontal orientation to present an angled surface along the length of the angled gripping portion for applying a rearward force to rotate the lever switch into a vertical orientation.

9. The firearm of claim 7, wherein the arm portion has ribbing thereon for providing a gripping surface.

10. The firearm of claim 7, wherein the lever switch has a generally triangular outwardly exposed portion of the thumb pad defined by the lever arm and a rearward peripheral edge of the thumb pad when the lever switch is in the trigger release position, the lever arm and thumb pad defining a thumb knuckle receiving region.

* * * * *